US008662619B2

(12) United States Patent
Nukui

(10) Patent No.: US 8,662,619 B2
(45) Date of Patent: Mar. 4, 2014

(54) LIQUID EJECTION APPARATUS

(75) Inventor: Kosuke Nukui, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 163 days.

(21) Appl. No.: 13/429,403

(22) Filed: Mar. 25, 2012

(65) Prior Publication Data

US 2013/0076826 A1 Mar. 28, 2013

(30) Foreign Application Priority Data

Sep. 27, 2011 (JP) ..... 2011-210170

(51) Int. Cl.
*B41J 29/38* (2006.01)

(52) U.S. Cl.
USPC ..... 347/16

(58) Field of Classification Search
USPC ..... 347/5–20, 29, 32, 104
IPC ..... B41J 29/38
See application file for complete search history.

(56) References Cited

U.S. PATENT DOCUMENTS

| | | | | |
|---|---|---|---|---|
| 5,992,966 | A | 11/1999 | Nitta et al. | |
| 2006/0238592 | A1 | 10/2006 | Kadomatsu et al. | |
| 2010/0156983 | A1 * | 6/2010 | Tamaki | 347/16 |
| 2010/0182371 | A1 * | 7/2010 | Tomoguchi | 347/32 |
| 2010/0225689 | A1 * | 9/2010 | Kato et al. | 347/10 |
| 2011/0050791 | A1 | 3/2011 | Kagata et al. | |
| 2011/0199425 | A1 | 8/2011 | Kaiho et al. | |

FOREIGN PATENT DOCUMENTS

| | | | |
|---|---|---|---|
| JP | H10-157153 | A | 6/1998 |
| JP | 2003-165230 | A | 6/2003 |
| JP | 2006-247965 | A | 9/2006 |

OTHER PUBLICATIONS

Japan Patent Office, extended European Search Report for European Patent Application No. 12160734.5 (counterpart European patent application), dated Dec. 21, 2012.

* cited by examiner

*Primary Examiner* — Manish S Shah
*Assistant Examiner* — Roger W Pisha, II
(74) *Attorney, Agent, or Firm* — Baker Botts L.L.P.

(57) ABSTRACT

A liquid ejection apparatus, including: a conveyor mechanism; a recording head; a treatment-liquid application portion; a sealing mechanism for selectively taking a sealing state in which an ejection space is sealed or an unsealing state in which the ejection space is not sealed; a humid-airy supply mechanism for performing a humidifying operation to produce and supply the humid air into the ejection space in the sealing state; a forcible discharge mechanism for performing a forcible discharge operation for forcibly discharging recording liquid from the head; and a maintenance control section for, when a time elapsed from an occurrence of a jam to a clearance of the jam is less than a first time, performing the forcible discharge operation, and for, when the time is equal to or greater than the first time, performing the humidifying operation in the sealing state and then performing the forcible discharge operation.

12 Claims, 9 Drawing Sheets

LIQUID EJECTION APPARATUS

CROSS REFERENCE TO RELATED APPLICATION

The present application claims priority from Japanese Patent Application No. 2011-210170, which was filed on Sep. 27, 2011, the disclosure of which is herein incorporated by reference in its entirety.

BACKGROUND OF THE INVENTION

1. Field of the Invention

The present invention relates to a liquid ejection apparatus including at least one head and configured to eject or apply liquids that are different from each other.

2. Description of the Related Art

There is known an ink jet printer (as one example of a liquid ejection apparatus) including a plurality of heads configured to respectively eject liquids that have their respective properties different from each other. For example, one conventional printer includes: a recording head configured to eject ink; and a treatment-liquid head configured to eject pretreatment liquid having a property different from that of the ink. The pretreatment liquid is liquid having a function for improving a color development by coagulating or precipitating color agents (pigments or dyes) in the ink, for example.

SUMMARY OF THE INVENTION

In this printer, if a jam of a recording medium has occurred at a position opposite the recording head, the treatment liquid ejected from the treatment-liquid head and landed on the recording medium may contact a recording ejection face of the head. In this case, the color agents may be coagulated or precipitated on the ejection face by reaction between the ink and the treatment liquid. If this coagulation occurs in or near an ejection opening of the head, an ejection failure may be caused. If a length of time of the contact of the treatment liquid with the ejection face is relatively short, the ejection failure may be resolved by performing maintenance such as a forcible discharge operation in which the liquid is forcibly discharged from ejection openings of the recording head.

However, if the length of time of the contact of the treatment liquid with the ejection face exceeds a predetermined length of time, the ejection failure may not be resolved because a lump produced by the coagulation cannot be discharged from the ejection opening even if the forcible discharge operation is repeated.

This invention has been developed to provide a liquid ejection apparatus capable of resolving an ejection failure by discharging a lump from an ejection opening.

The present invention provides a liquid ejection apparatus, comprising: a conveyor mechanism configured to convey a recording medium in a conveying direction; a recording head having a recording ejection face that has a plurality of ejection openings from which the recording head ejects recording liquid onto the recording medium, an ejection space being defined so as to face the recording ejection face; a treatment-liquid application portion provided upstream of the recording head in the conveying direction and configured to apply treatment liquid to the recording medium, the treatment liquid containing a component for coagulating or precipitating a component in the recording liquid; a sealing mechanism configured to selectively take one of (i) a sealing state in which the sealing mechanism seals the ejection space from an outside space and (ii) an unsealing state in which the sealing mechanism does not seal the ejection space from the outside space; a humid-air supply mechanism configured to perform a humidifying operation in which the humid-air supply mechanism produces humid air to supply the humid air into the ejection space in the sealing state; a forcible discharge mechanism configured to perform a forcible discharge operation in which the forcible discharge mechanism applies a pressure to the recording liquid in the recording head to forcibly discharge the recording liquid from the plurality of ejection openings; a jam sensing section configured to sense an occurrence of a jam of the recording medium between the conveyor mechanism and the recording ejection face; an output portion configured to output a jam-dealing completion signal corresponding to a clearance of the jam which allows the conveyor mechanism to convey the recording medium; a measurement section configured to measure a time elapsed from the sense of the occurrence of the jam by the jam sensing section to the output of the jam-dealing completion signal by the output portion; and a maintenance control section configured, when the time measured by the measurement section is less than a first time, to control the forcible discharge mechanism to perform the forcible discharge operation, and configured, when the time is equal to or greater than the first time, to control the sealing mechanism and the humid-air supply mechanism to perform the humidifying operation in the state in which the sealing mechanism is in the sealing state and then control the forcible discharge mechanism to perform the forcible discharge operation.

The present invention also provides a liquid ejection apparatus, comprising: a conveyor mechanism configured to convey a recording medium in a conveying direction; a recording head having a recording ejection face that has a plurality of ejection openings from which the recording head ejects recording liquid onto the recording medium, an ejection space being defined so as to face the recording ejection face; a treatment-liquid application portion provided upstream of the recording head in the conveying direction and configured to apply treatment liquid to the recording medium, the treatment liquid containing a component for coagulating or precipitating a component in the recording liquid; a sealing mechanism configured to selectively take one of (i) a sealing state in which the sealing mechanism seals the ejection space from an outside space and (ii) an unsealing state in which the sealing mechanism does not seal the ejection space from the outside space; a humid-air supply mechanism configured to perform a humidifying operation in which the humid-air supply mechanism produces humid air to supply the humid air into the ejection space in the sealing state; a forcible discharge mechanism configured to perform a forcible discharge operation in which the forcible discharge mechanism applies a pressure to the recording liquid in the recording head to forcibly discharge the recording liquid from the plurality of ejection openings; a jam sensing section configured to sense an occurrence of a jam of the recording medium between the conveyor mechanism and the recording ejection face; a measurement section configured to measure a time corresponding to a duration of a state of the jam whose occurrence has been sensed by the jam sensing section; and a maintenance control section configured, when the time corresponding to the duration is a first duration, to control the forcible discharge mechanism to perform the forcible discharge operation without performing the humidifying operation in the state in which the sealing mechanism is in the sealing state, and configured, when the time corresponding to the duration is a second duration that is greater than the first duration, to control the sealing mechanism and the humid-air supply mechanism to perform the humidifying operation in the state in which the sealing mechanism is in the sealing state and then control the forcible discharge mechanism to perform the forcible discharge operation.

BRIEF DESCRIPTION OF THE DRAWINGS

The objects, features, advantages, and technical and industrial significance of the present invention will be better understood by reading the following detailed description of the embodiment of the invention, when considered in connection with the accompanying drawings, in which.

DETAILED DESCRIPTION OF THE EMBODIMENT

Figure 1:
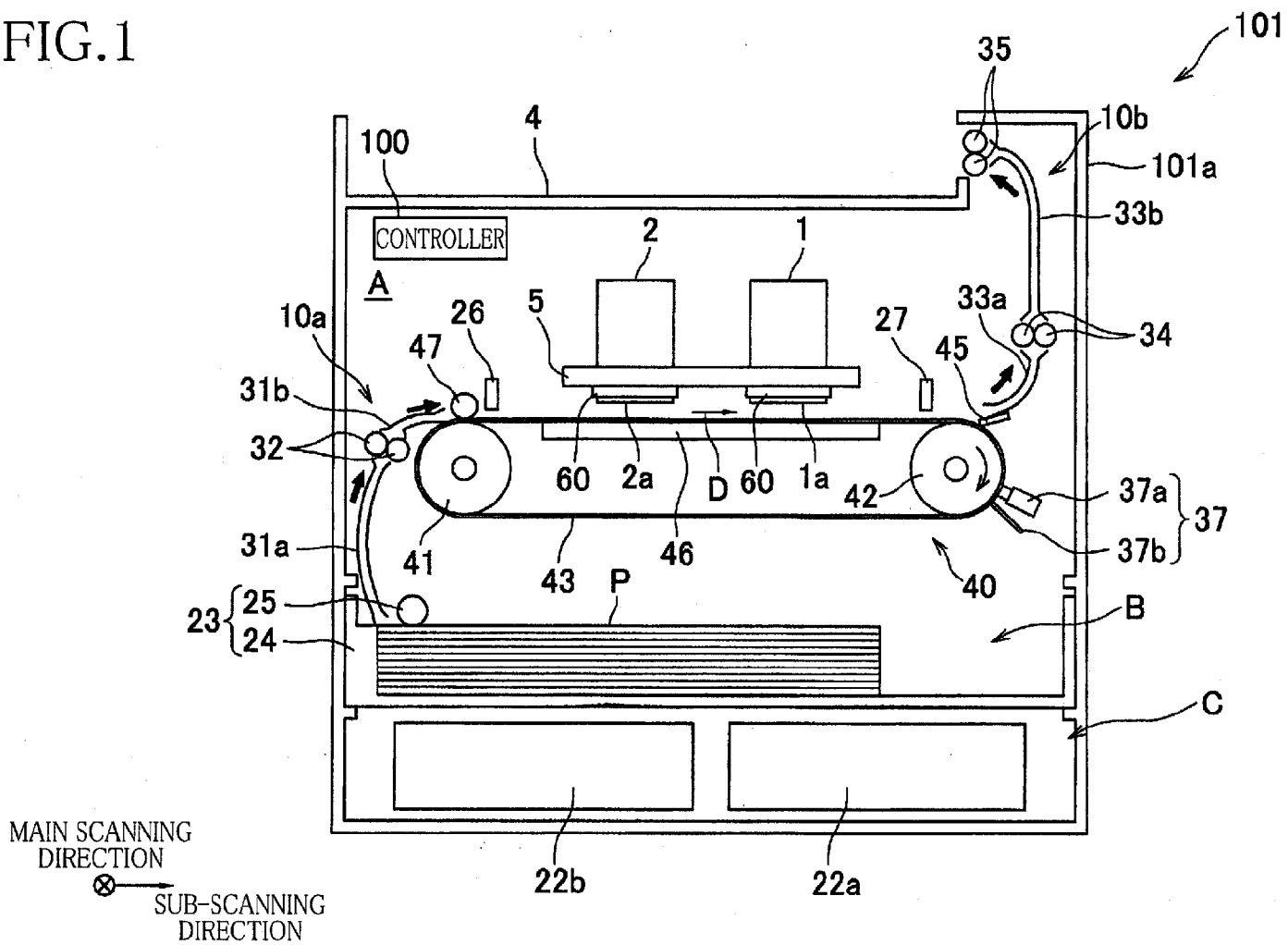
FIG. 1 is a side view generally showing an internal structure of an ink jet printer as one embodiment of a liquid ejection apparatus to which the present invention is applied.

Hereinafter, there will be described one embodiment of the present invention by reference to the drawings.

First, there will be explained an overall construction of an ink-jet printer 101 as one embodiment of a liquid ejection apparatus to which the present invention is applied.

The printer 101 includes a housing 101*a* having a rectangular parallelepiped shape. A sheet-discharge portion 4 is provided on a top plate of the housing 101*a*. An inner space of the housing 101*a* is divided into spaces A, B, and C in order from an upper side thereof. In the spaces A and B is formed a sheet conveyance path extending from a sheet-supply portion 23 to the sheet-discharge portion 4. A recording medium in the form of a sheet P is conveyed through the sheet conveyance path along bold arrows indicated in FIG. 1. In the space A, an image is formed or recorded on the sheet P, and the sheet P is conveyed to the sheet-discharge portion 4. In the space B, the sheet P is supplied to the conveyance path. In the space C, ink is supplied to a head 1 in the space A, and pretreatment liquid is supplied to a head 2 in the space A.

Components arranged in the space A include: the head 1 (as one example of a recording head); the head 2 (as one example of a treatment-liquid head and a treatment-liquid application portion); a conveyor mechanism 40; two guide portions 10*a*, 10*b* for guiding the sheet P; two sheet sensors 26, 27; a humid-air supply mechanism 50 (see FIGS. 6A and 6B) used for a humidifying operation; a head raising and lowering mechanism 33 (see FIG. 8); wiper units 36 (see FIGS. 10A and 10B); a cleaner unit 37; and a controller 100.

The head 1 ejects black ink, and the head 2 ejects the pretreatment liquid. The head 2 is disposed upstream of the head 1 in a conveying direction indicated by sign "D" in FIG. 1. These two heads 1, 2 have the same structure. The heads 1, 2 are arranged so as to be spaced from each other at a predetermined distance in a sub-scanning direction and supported by the housing 101*a* via a head holder 5. A lower face of the head 1 is an ejection face 1*a*, and a lower face of the head 2 is an ejection face 2*a*. A multiplicity of ejection openings 108 (see FIG. 3) are formed and arranged in each of the ejection faces 1*a*, 2*a*. The head holder 5 holds and supports the heads 1, 2 so as to form a predetermined space suitable for the recording, between the ejection faces 1*a*, 2*a* and a conveyor belt 43.

Each of the heads 1, 2 is a stacked body including: a head main body 3 (see FIG. 2) constituted by a channel unit 9 and actuator units 21; a reservoir unit; a flexible printed circuit (FPC); and a control board which are stacked on one another. Signals generated by the control board are converted by a driver IC on the FPC to drive signals. These drive signals are outputted to the actuator units 21. When the actuator units 21 are activated, the ink supplied from the reservoir unit is ejected from the ejection openings 108.

Caps 60 of the humid-air supply mechanism 50 are mounted on the head holder 5. Each of the caps 60 is an annular member provided for a corresponding one of the heads 1, 2 and encloses the corresponding one of the heads 1, 2 in plan view. A structure, an operation, a function, and so on of each cap 60 will be explained later in detail.

The conveyor mechanism 40 includes: two belt rollers 41, 42; the conveyor belt 43; a platen 46; a nip roller 47; and a peeling plate 45. The conveyor belt 43 is an endless belt wrapped around the rollers 41, 42. The platen 46 are disposed opposite the two heads 1, 2 so as to support an upper loop of the conveyor belt 43 from an inside thereof. The belt roller 42 is a drive roller that rotates the conveyor belt 43. The belt roller 42 is rotated in a clockwise direction in FIG. 1 by a motor, not shown. The belt roller 41 is a driven roller that is rotated by the rotation of the conveyor belt 43. The nip roller 47 presses the sheet P supplied from the sheet-supply portion 23, onto an outer circumferential face of the conveyor belt 43. The sheet P is conveyed toward the heads 1, 2 while held by a silicon layer of the conveyor belt 43 which is a layer having a low viscosity for covering the outer circumferential face of the conveyor belt 43. The peeling plate 45 peels the conveyed sheet P off from the conveyor belt 43 and guides the sheet P toward the sheet-discharge portion 4.

The two guide portions 10*a*, 10*b* are disposed so as to interpose the conveyor mechanism 40 therebetween. The upstream guide portion 10*a* in the conveying direction includes two guides 31*a*, 31*b* and a conveyor roller pair 32 and connects between the sheet-supply portion 23 and the conveyor mechanism 40. The sheet P to be recorded is conveyed toward the conveyor mechanism 40. The downstream guide portion 10*b* in the conveying direction includes two guides 33*a*, 33*b* and two conveyor roller pairs 34, 35 and connects between the conveyor mechanism 40 and the sheet-discharge portion 4. The sheet P on which an image has been recorded is conveyed toward the sheet-discharge portion 4.

As shown in FIG. 1, the two sheet sensors 26, 27 are disposed so as to interpose the heads 1, 2 from opposite sides thereof in the conveying direction. The upstream sensor 26 senses a leading end of the sheet P to output a sense signal based on which a timing at which the liquid is ejected is determined. The downstream sensor 27 also senses the leading end of the sheet P. The sensors 26, 27 partly constitute a jam sensing section 144 (which will be described below).

Figure 10A:
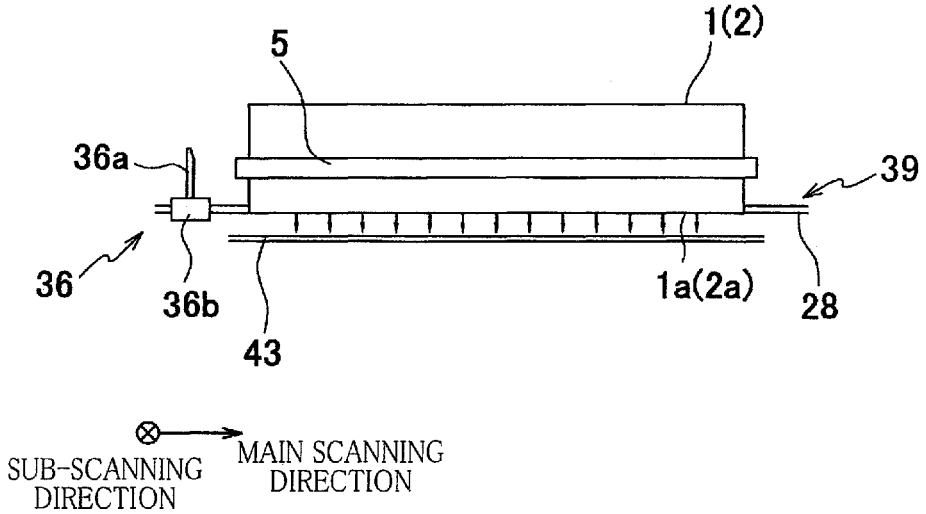
FIGS. 10A and 10B are views for explaining a wiping operation.
Figure 10B:
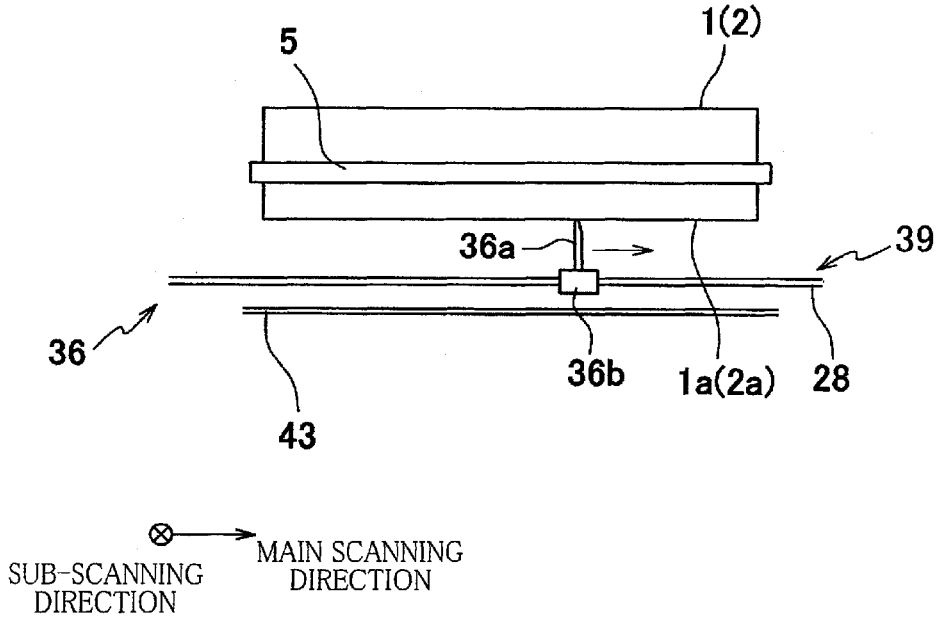

The head raising and lowering mechanism 33 is configured to raise and lower the head holder 5 to move each of the two heads 1, 2 between a recording position and a retracted position. As shown in FIG. 1, the two heads 1, 2 located at the recording position are opposed to the conveyor belt 43 so as to be spaced apart from each other at the distance suitable for the recording. As shown in FIG. 10B, the two heads 1, 2 located at the retracted position are distant from the conveyor belt 43 at a distance greater than that at the recording position. At the retracted position, each of wipers 36*a* which will be described below is movable in a space formed between a corresponding one of the two heads 1, 2 and the conveyor belt 43.

The wiper units 36 are provided respectively for the ejection faces 1*a*, 2*a*, and as shown in FIG. 10, each of the wiper units 36 includes: the wiper 36*a*; a base portion 36*b* for supporting the wiper 36*a*; and a wiper moving mechanism 39. The wiper 36*a* is a plate-like elastic member formed of a rubber, for example. Each of the wipers 36*a* is slightly longer than a width of a corresponding one of the ejection faces 1*a*, 2*a*. The base portion 36*b* has a rectangular parallelepiped shape elongated in the sub-scanning direction and has two holes respectively formed in its opposite ends. These holes are formed through the base portion 36*b* in a main scanning direction, and a female thread is formed in an inner face of one of the holes. The wiper moving mechanism 39 is constituted by a pair of guides (e.g., round rods) 28 extending in the main scanning direction and a drive motor, not shown. The pair of guides 28 are rod members inserted and fitted in the respective holes, and each pair of guides 28 respectively hold side faces of the corresponding one of the heads 1, 2 in the sub-scanning direction from opposite sides thereof. A male thread is formed in an outer circumferential face of one of the guides 28 and is engaged with the female thread of the hole. This guide 28 receives a rotational power of the drive motor. The other guide 28 slides on an inner circumferential face of the other hole.

Forward and reverse rotations of the drive motor reciprocate the base portion 36*b* along the guides 28. As shown in FIG. 10A, a position near a left end portion of each of the heads 1, 2 is a wait position of the corresponding base portion 36*b*. In wiping, the wiper 36*a* is moved rightward in FIGS. 10A and 10B to wipe the ejection face of the corresponding one of the heads 1, 2 located at a wiping position. The wiping position is located between the recording position and the retracted position. After each of the heads 1, 2 is moved to the retracted position, the wiper 36*a* is returned to the wait position.

Figure 8:
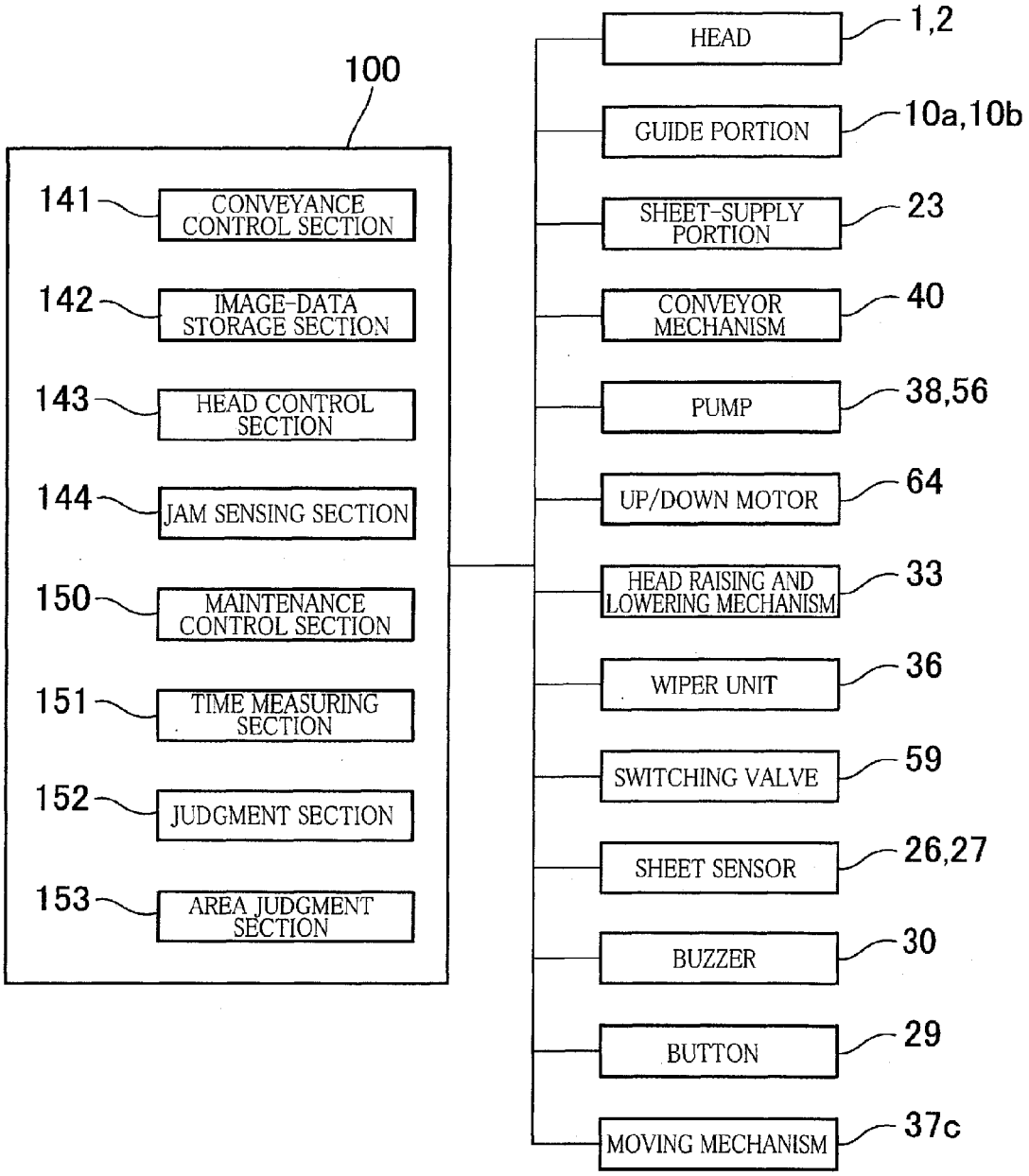
FIG. 8 is a functional block diagram of a controller in FIG. 1.

The cleaner unit 37 includes a cleaning-liquid application member 37*a*, a blade 37*b*, and a moving mechanism 37*c* (see FIG. 8). The cleaner unit 37 is for cleaning the outer circumferential face of the conveyor belt 43. As shown in FIG. 1, the cleaner unit 37 is disposed opposite the belt roller 42 so as to be located on a right and lower side of the conveyor belt 43. The cleaning-liquid application member 37*a* is constituted by a porous body (formed by a sponge, for example) and a support member for supporting this porous body. The blade 37*b* is a plate-like elastic member formed of a rubber, for example. Both of the cleaning-liquid application member 37*a* and the blade 37*b* are contactable with an entire width of the conveyor belt 43. The moving mechanism 37*c* moves the cleaning-liquid application member 37*a* and the blade 37*b* to or away from the outer circumferential face of the conveyor belt 43. In a cleaning operation, the conveyor belt 43 is rotated in a state in which the cleaning-liquid application member 37*a* and the blade 37*b* are held in contact with the outer circumferential face of the conveyor belt 43, whereby cleaning liquid is applied from the porous body to the outer circumferential face, and then the blade 37*b* located downstream of the porous body wipes and removes stains and the cleaning liquid from the outer circumferential face.

The sheet-supply portion 23 is disposed in the space B. The sheet-supply portion 23 includes a sheet-supply tray 24 and a sheet-supply roller 25. The sheet-supply tray 24 is mountable on and removable from the housing 101*a*. The sheet-supply tray 24 has a box shape opening upward and can accommodate a plurality of the sheets P. The sheet-supply roller 25 is rotated to supply an uppermost one of the sheets P accommodated in the sheet-supply tray 24.

Here, the sub-scanning direction is a direction parallel to the conveying direction D in which the sheet is conveyed by the conveyor mechanism 40, and the main scanning direction is a direction parallel to a horizontal plane and perpendicular to the sub-scanning direction.

Arranged in the space C are a cartridge 22*a* storing the black ink (as one example of recording liquid) and a cartridge 22*b* storing the clear and colorless pretreatment liquid. These cartridges 22*a*, 22*b* are mountable on and removable from the housing 101*a*. Each of these cartridges 22*a*, 22*b* communicates with a corresponding one of the heads 1, 2 via a corresponding one of tubes, not shown, and a corresponding one of pumps 38 (see FIG. 8). It is noted that each pump 38 (as one example of a forcible discharge mechanism) is stopped at times other than a time that the liquid (the ink and the pretreatment liquid) is forcibly transferred to the head 1 or 2. Thus, the pumps 38 never inhibit the liquid supply to the heads 1, 2.

In general, pretreatment liquid for coagulating pigments is used for pigment ink, and pretreatment liquid for precipitating dyes is used for dye ink. Materials of the pretreatment liquid can be selectively employed from among liquid and the like containing a cationic high polymer and/or polyvalent metal salt such as magnesium salt. When the pretreatment liquid and the ink are mixed with each other, the components such as the polyvalent metal salt act on the dyes or the pigments as coloring agents of the ink so as to coagulate or precipitate the coloring agents of the ink, thereby forming a hardly soluble metal complex (a lump) and so on.

There will be next explained the controller 100. The controller 100 controls the components of the printer 101 to control the operations of the printer 101. The controller 100 controls an image recording operation based on a recording command supplied from an external device such as a PC connected to the printer 101. Specifically, the controller 100 controls other operations such as the conveyance operation of the sheet P and the liquid ejecting operation synchronized with the conveyance of the sheet P.

Based on the recording command received from the external device, the controller 100 controls the sheet-supply portion 23, the conveyor mechanism 40, and the conveyor roller pairs 32, 34, 35. The sheet P supplied from the sheet-supply tray 24 is conveyed to the conveyor mechanism 40 while guided by the upstream guide portion 10*a*. When the sheet P conveyed by the conveyor mechanism 40 passes through a position just under the head 2, the head 2 ejects the pretreatment liquid onto an image recording area of an upper face of the sheet P. When the sheet P passes through a position just under the head 1, the head 1 ejects the ink onto the image recording area of the upper face. As a result, a desired image is formed on the sheet P. In this operation, the pretreatment liquid coagulates or precipitates the coloring agents of the ink on the image recording area of the upper face, making it possible to prevent spread of the ink on the sheet P. The sheet P on which the image is formed is peeled off from the conveyor belt 43 by the peeling plate 45 and then discharged onto the sheet-discharge portion 4 from an upper portion of the housing 101 while guided by the downstream guide portion 10*b*.

Further, the controller 100 controls a maintenance operation. In this maintenance operation, a liquid ejection characteristic of each of the heads 1, 2 is recovered or maintained, and a preparation of the recording is performed. The maintenance operation includes a purging operation, a flushing operation, the wiping operations for wiping the ejection faces 1*a*, 2*a*, the cleaning operation of the conveyor belt 43, a capping, and the humidifying operation.

In the purging operation, the pump 38 is driven, and the ink is forcibly discharged from all the ejection openings 108. In this operation, the actuator units 21 are not driven. In the flushing operation, the actuator units 21 are driven, and the ink is ejected from the ejection openings 108. This ink ejection is performed based on flushing data that is data different from image data based on which the image recording is performed. In the wiping operation, the wipers 36*a* (see FIGS. 10A and 10B) respectively wipe the ejection faces 1*a*, 2*a*. The wiping operation is performed after the purging operation, and the liquid and foreign matters on the ejection faces 1*a*, 2*a* are removed. In the cleaning operation, the conveyor belt 43 is wiped by the cleaner unit 37. The cleaning operation is performed after the purging operation and the flushing operation, and the ink and foreign matters on the conveyor belt 43 are removed.

Figure 6A:
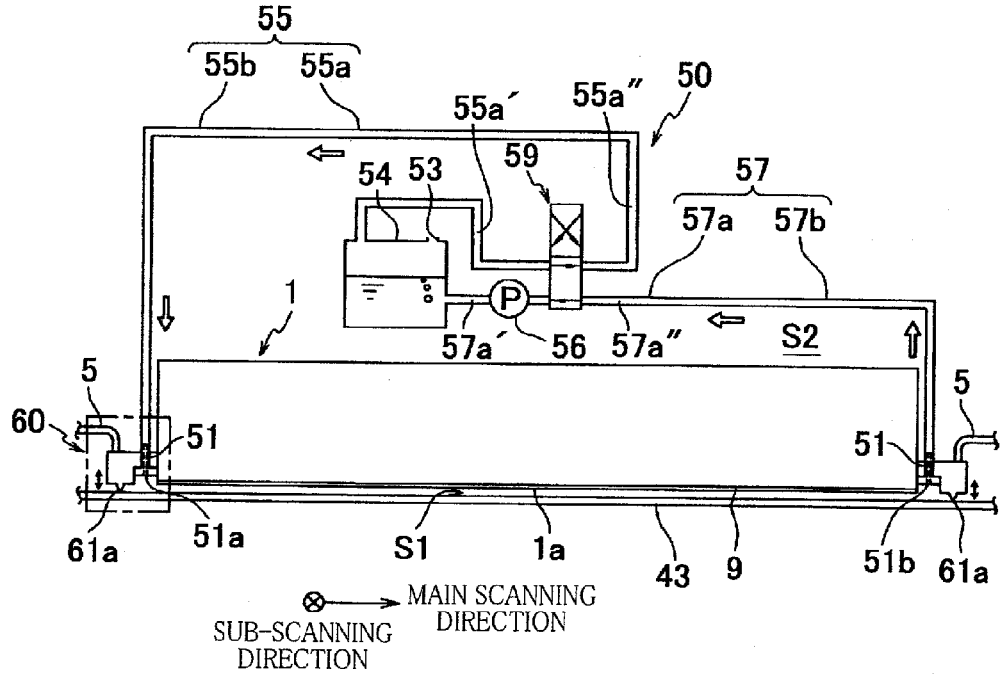
FIGS. 6A and 6B are schematic views showing a head holder and a humid-air supply mechanism included in the printer in FIG. 1.
Figure 6B:
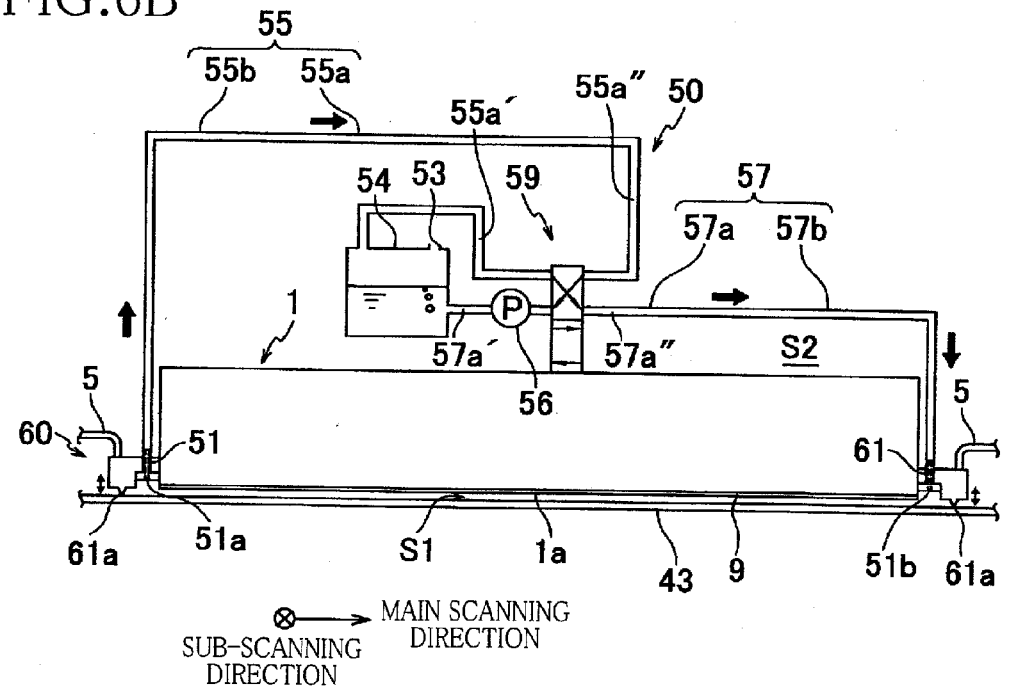

As shown in FIGS. 6A and 6B, in the capping for each of the heads 1, 2, an ejection space S1 defined under the ejection face 1*a* or 2*a* (defined so as to face the ejection face 1*a* or 2*a* (the ejection openings 108)) is isolated from an outside space S2 by the cap 60. This suppresses drying of the ink (especially ink meniscuses). As shown in FIGS. 6A and 6B, in the humidifying operation, a humid air is supplied into the isolated ejection space S1. As a result, water vapors accumulate in the ejection space S1 sealed by the capping, thereby further suppressing the drying of the liquid (the meniscuses). Further, the humidifying operation humidifies and softens the lump produced by the coagulation.

Figure 2:
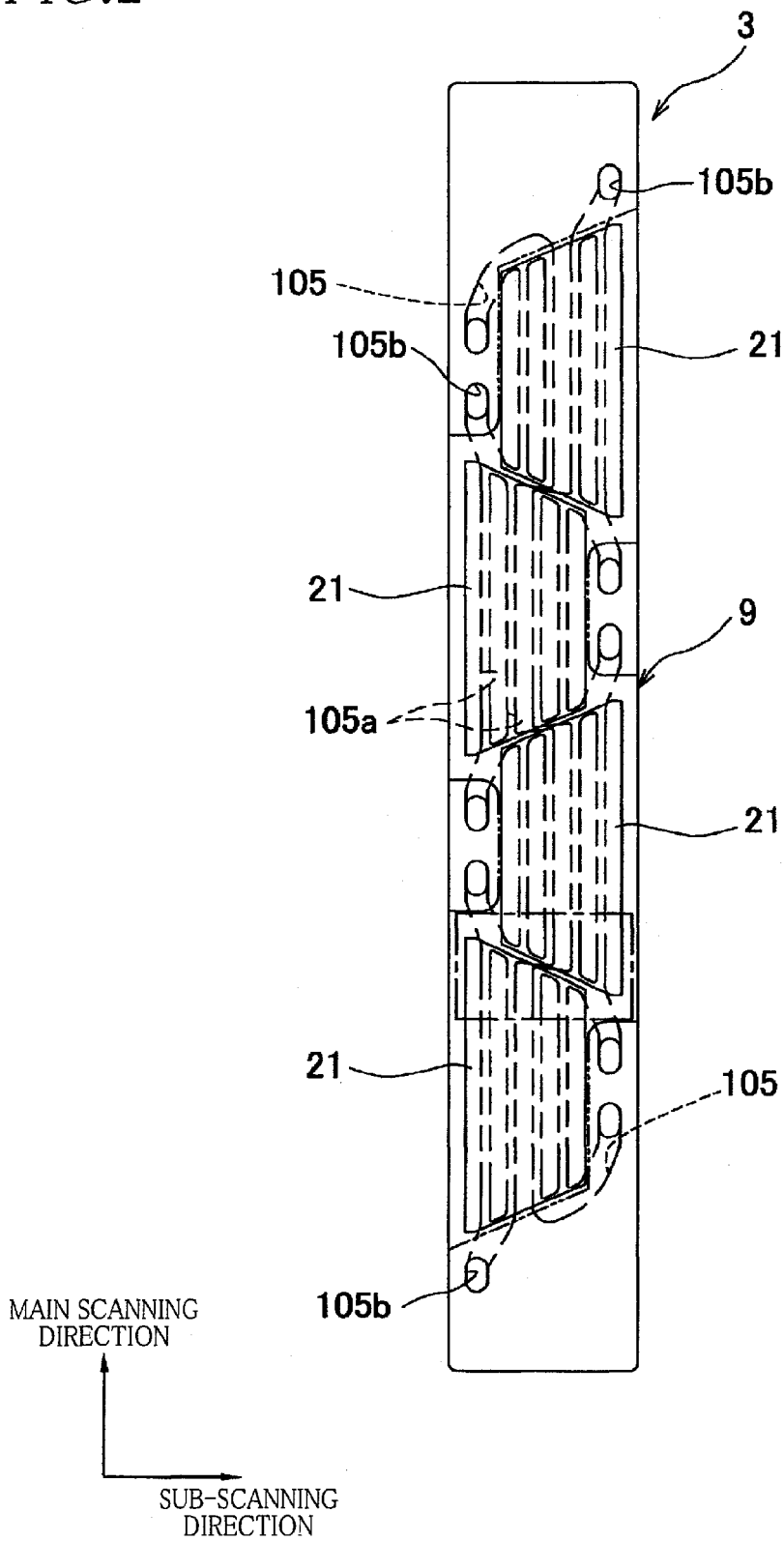
FIG. 2 is a plan view showing a head main body of a head included in the printer in FIG. 1.
Figure 3:
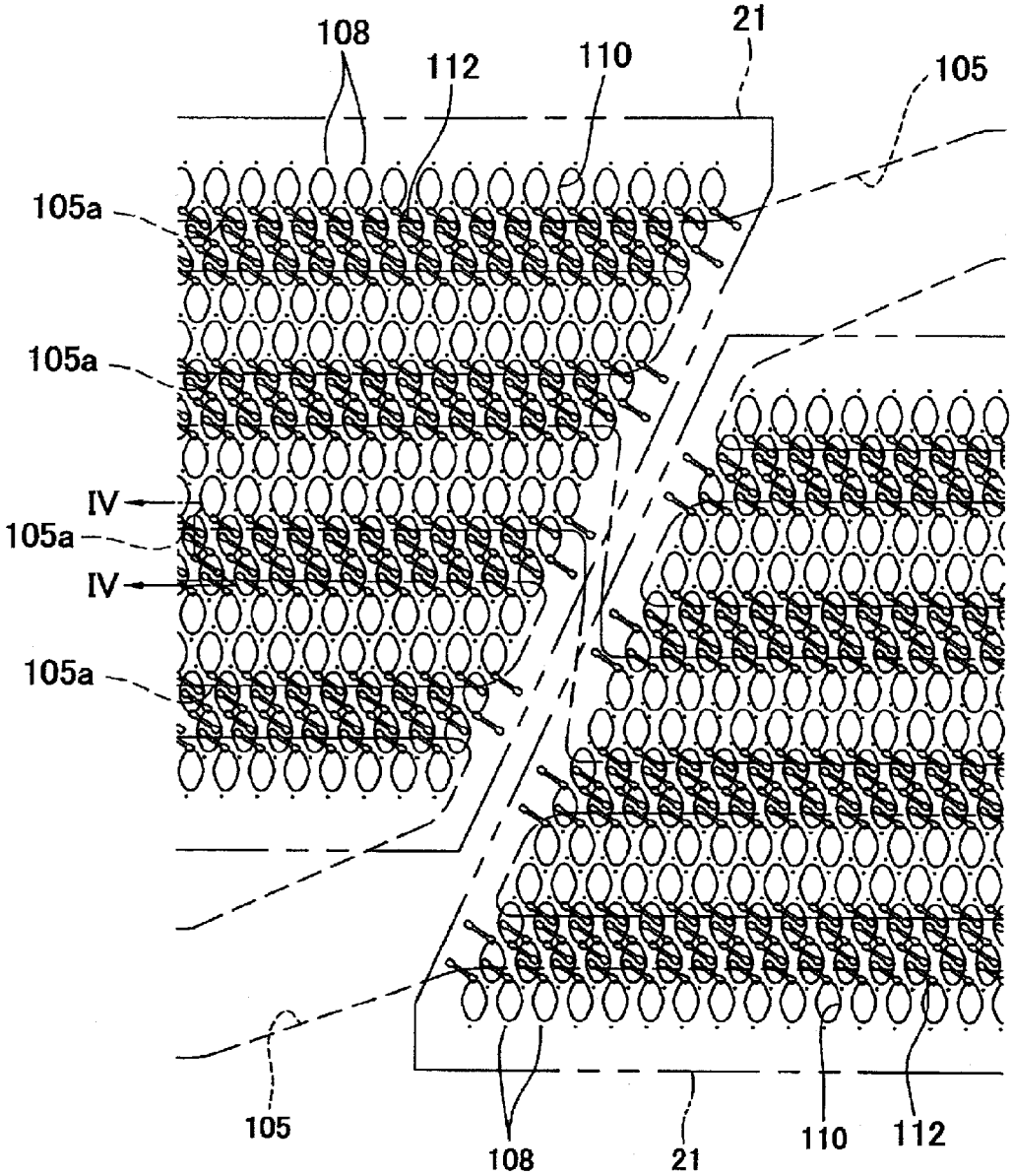
FIG. 3 is an enlarged view showing an area enclosed by one-dot chain line in FIG. 2.

There will be next explained the heads 1, 2 with reference to FIGS. 2-5. It is noted that, since the heads 1, 2 have the same structure, the following explanation is given only for the head 1, and an explanation of the head 2 is omitted. In FIG. 3, pressure chambers 110, apertures 112, and the ejection openings 108 are illustrated by solid lines for easier understanding purposes though these elements are located under the actuator units 21 and thus should be illustrated by broken lines.

Figure 4:
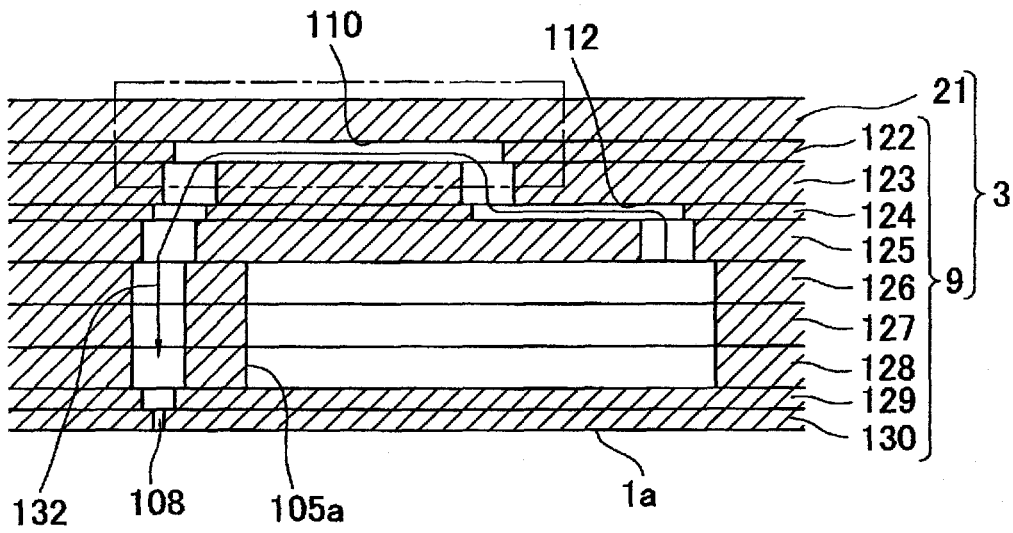
FIG. 4 is a partial cross-sectional view taken along line IV-IV in FIG. 3.

As shown in FIG. 4, the channel unit 9 is a stacked body constituted by nine metal plates 122-130 formed of stainless steel stacked on one another. As shown in FIG. 2, an upper face of the channel unit 9 has ten ink supply openings 105*b* opening therein. As shown in FIGS. 2-4, manifold channels 105 and sub-manifold channels 105*a* are formed in the channel unit 9. Each of the ink supply openings 105*b* communicates with a corresponding one of the manifold channels 105, and each of the sub-manifold channels 105*a* is branched from a corresponding one of the manifold channels 105. Further, in the channel unit 9 are also formed individual ink channels 132 each extending from a corresponding one outlet of the sub-manifold channels 105*a* to a corresponding one of the ejection openings 108 via a corresponding one of the apertures 112 and a corresponding one of the pressure chambers 110. A lower face of the channel unit 9 is the ejection face 1*a* in which the ejection openings 108 are formed in matrix.

The reservoir unit is a channel member in which ink channels are formed like the channel unit 9. The ink to be supplied to the channel unit 9 is stored in a reservoir of the ink channels. As shown in FIGS. 2-4, the ink in the reservoir unit is supplied from the ink supply openings 105*b* to the channel unit 9.

The pumps 38 are provided respectively for the heads 1, 2. Each pump 38 forcibly supplies the liquid (the ink or the pretreatment liquid) into the channel unit 9 via the reservoir unit. FIG. 8 shows one pump 38.

There will be next explained the actuator units 21. The actuator units 21 are fixed to the upper face of the channel unit 9 and partly constitute the head main body 3. As shown in FIG. 2, each of the four actuator units 21 has a trapezoid shape in plan view, and the four actuator units 21 are arranged in a staggered configuration in the main scanning direction so as not to overlap the ink supply openings 105*b*.

Figure 5:
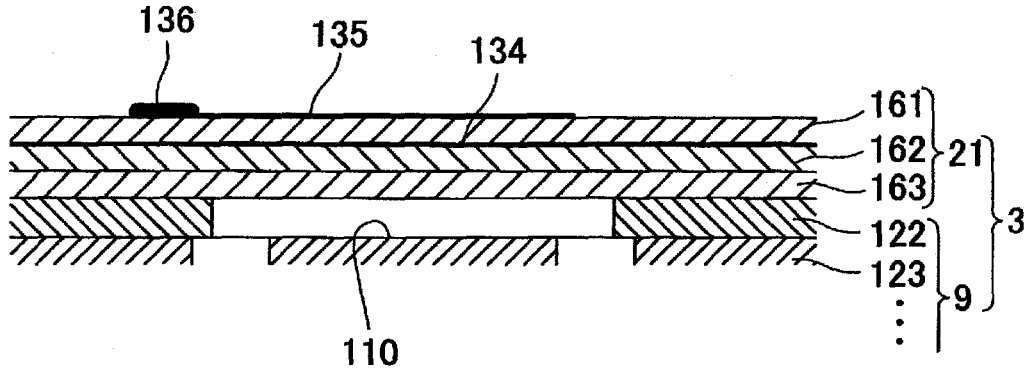
FIG. 5 is an enlarged view showing an area enclosed by one-dot chain line in FIG. 4.

Each of the actuator units 21 is a piezoelectric actuator constituted by three piezoelectric layers 161-163 each formed of a ceramic material of lead zirconate titanate (PZT) having ferroelectricity. The uppermost piezoelectric sheet 161 is polarized in a thickness direction thereof and sandwiched between (a) individual electrodes 135 disposed on an upper face of the piezoelectric sheet 161 and (b) a common electrode 134 expanding across a lower face of the piezoelectric sheet 161. As shown in FIG. 5, the most part of each individual electrode 135 is opposite the corresponding pressure chamber 110, and a part of the individual electrode 135 not overlapping the pressure chamber 110 in plan view is connected to a corresponding one of individual lands 136. This configuration is formed for each pressure chamber 110, and each configuration serves as an individual actuator. That is, the actuator units 21 include the actuators respectively corresponding to the pressure chambers 110, and each actuator selectively applies an ejection energy to the ink in the corresponding pressure chamber 110.

Here, there will be explained a method for driving each actuator unit 21. Each actuator is what is called a unimorph actuator. When an electric field in the polarization direction is applied to each portion of the piezoelectric layer 161 which is sandwiched between the common electrode 134 and the corresponding individual electrode 135, the portion is contracted in a direction perpendicular to the polarization direction (i.e., in a planar direction). This contraction contracts portions of the piezoelectric layers 162, 163 just under the contracted portion of the piezoelectric layer 161, but an amount of the contraction of the portion of the piezoelectric layer 162 and that of the portion of the piezoelectric layer 163 are different from each other. Thus, the portions of the piezoelectric layers 161-163 which are sandwiched between the individual electrode 135 and the pressure chamber 110 project toward the pressure chamber 110. This deformation applies a pressure (the ejection energy) to the ink in the pressure chamber 110, causing a droplet of the liquid to be ejected from the ejection opening 108.

It is noted that, in the present embodiment, a drive signal is applied to the individual electrode 135 maintained at a predetermined electric potential, and thereby the electric potential of the individual electrode 135 temporarily becomes a ground potential and then returns to the predetermined electric potential at a predetermined timing. This ejection method is what is called a "fill-before-fire" method. When the electric potential temporarily becomes the ground potential, a volume of the pressure chamber 110 increases, and the ink is sucked into the pressure chamber 110. When the electric potential returns to the predetermined electric potential, the volume of the pressure chamber 110 decreases (an ink pressure increases), and thereby the ink droplet is ejected from the ejection opening 108.

Figure 7:
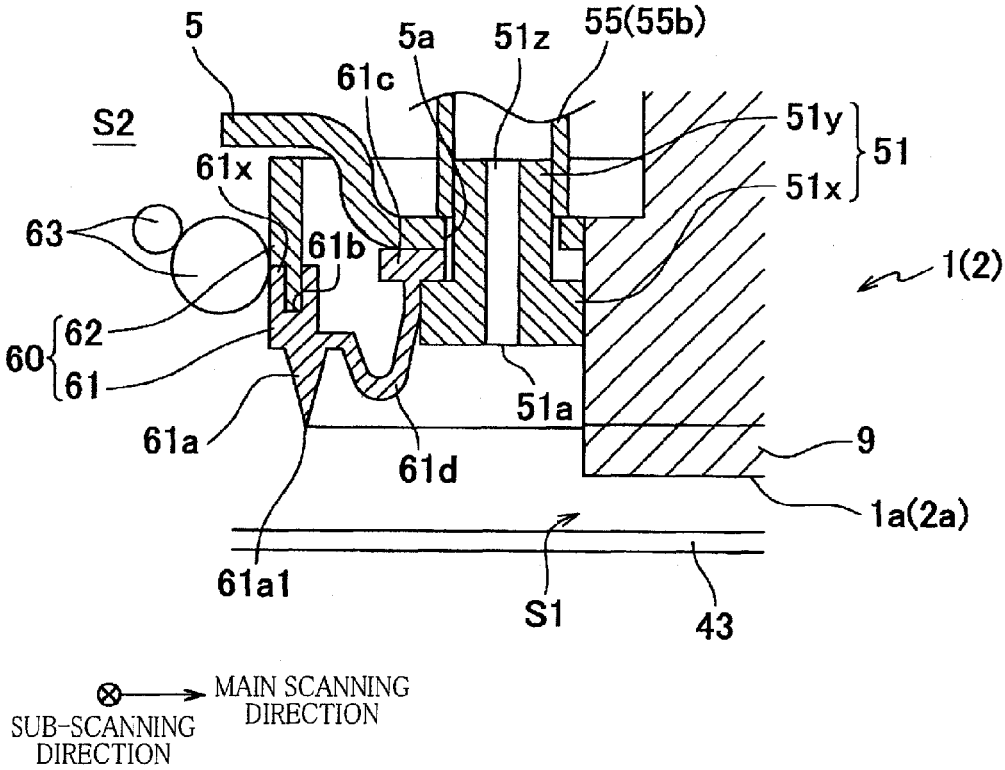
FIG. 7 is a partial cross-sectional view showing an area enclosed by one-dot chain line in FIG. 6 and showing a situation in which a cap located at a distant position.

There will be next explained a sealing mechanism mounted on the head holder 5 with reference to FIGS. 6A, 6B, and 7.

The head holder 5 is a frame formed of a metal, for example, and supporting side faces of the heads 1, 2 in their entire perimeters. The head holder 5 is a support member for the heads 1, 2 and is also a member of the sealing mechanism. The caps 60 are mounted on the head holder 5. Here, a contact portion of the head holder 5 and each of the heads 1, 2 is sealed by a sealant in their entire perimeters. Further, a contact portion of the head holder 5 and each of the caps 60 is fixed by an adhesive in their entire perimeters.

The sealing mechanism includes: the head holder 5; the caps 60; an up/down motor 64 (see FIG. 8); an up/down power transmitting mechanism including a plurality of gears 63; and the conveyor belt 43. Since the caps 60 have the same structure, and the heads 1, 2 have the same structure, the following explanation will be given for the head 1 and the cap 60 corresponding thereto for the sake of simplicity unless otherwise required by context. The cap 60 is brought into contact with or is moved away from the conveyor belt 43, whereby the sealing mechanism becomes an unsealing state in which the ejection space S1 located opposite the ejection face 1*a* is not sealed or a sealing state in which the ejection space S1 is sealed so as to be isolated from the outside space S2. The cap 60 is a rectangular annular member and encloses entire outer faces of the head 1 in plan view. As shown in FIG. 7, the cap 60 is constituted by a movable member 61 and a movable member 62.

The movable member 61 is an annular member formed of an elastic material such as a rubber and encloses the head 1 in plan view. As shown in FIG. 7, the movable member 61 includes: a base portion 61*x*; a projecting portion 61*a* projecting from a lower face of the base portion 61*x*; a fixed portion 61*c* fixed to the head holder 5; and a connecting portion 61*d* connecting between the base portion 61*x* and the fixed portion 61*c*. The projecting portion 61*a* has a triangle shape in its cross section. In other words, the projecting portion 61*a* is tapered toward its lower end. The fixed portion 61*c* has a T-shape in its cross section. A flat upper end portion of the fixed portion 61*c* is fixed to the head holder 5 by an adhesive or the like. The fixed portion 61*c* is supported by and between the head holder 5 and a basal end portion 51*x* of each of joints 51 which will be described below. The connecting portion 61*d* curves from a lower end of the fixed portion 61*c* so as to extend toward an outside (i.e., in a direction away from the ejection face 1*a* in plan view) and finally is connected to a side face of a lower portion of the base portion 61*x*. The connecting portion 61*d* is deformed when the movable member 62 is moved upward or downward. A recessed portion 61*b* is formed in an upper face of the base portion 61*x*. A lower end of the movable member 62 is fitted in this recessed portion 61*b*.

The movable member 62 is an annular member formed of a rigid material such as a stainless steel and encloses the outer faces of the head 1 in plan view. The movable member 62 is supported by the base portion 61*x* so as to be movable relative to the head holder 5 in a vertical direction. The movable member 62 is connected to the up/down motor 64 via the gears 63. When the up/down motor 64 (see FIG. 8) is driven by the control of the controller 100, the gears 63 are rotated, which moves the movable member 62 upward or downward. As a result, a position of a distal end 61*a*1 of the projecting portion 61*a* relative to the ejection face 1*a* is changed in the vertical direction. In the present embodiment, the single up-down motor 64 selectively outputs its driving power to the gears 63 for the cap 60.

The projecting portion 61*a* is selectively positioned at a contact position (see FIGS. 6A and 6B) at which the distal end 61*a*1 is held in contact with the outer circumferential face of the conveyor belt 43 or at a distant position (see FIG. 7) at which the distal end 61*a*1 is distant from the outer circumferential face. At the contact position, the sealing mechanism is in the sealing state in which the ejection space S1 is isolated from the outside space S2. At the distant position, the sealing mechanism is in the unsealing state in which the ejection space S1 communicates with and opens to the outside space S2.

There will be next explained a structure of the humid-air supply mechanism 50 with reference to FIGS. 6A and 6B. The humid-air supply mechanism 50 includes: the cap 60 of the sealing mechanism; a pair of the joints 51; tubes 55, 57; a switching valve 59 as one example of a supply-opening switch portion; a pump 56; and a tank 54. The cap 60 encloses and seals the ejection space S1, and each joint 51 is for replacing an air in the space S1 with a humid air.

The pair of joints 51 function as an inlet or an outlet through which the humid air is supplied into or discharged from the ejection space S1. As shown in FIGS. 6A and 6B, the pair of joints 51 include a left joint 51 having an opening 51*a* and a right joint 51 having an opening 51*b*. The pair of joints 51 are disposed so as to interpose the head 1 (the ejection openings 108) therebetween in the main scanning direction. In the humidifying operation, the humid air is supplied into the ejection space S1 from one of the two openings 51*a*, 51*b*, and the air in the ejection space S1 is discharged from the other of the two openings 51*a*, 51*b*.

Each joint 51 is constituted by the basal end portion 51*x* having a square shape in plan view and a distal end portion 51*y* having a circular cylindrical shape. In the joint 51, a hollow space 51*z* (see FIG. 7) is formed through the basal end portion 51*x* and the distal end portion 51*y* in the vertical direction. The hollow space 51*z* has a circular cylindrical shape in the distal end portion 51*y* and has a fan shape in the basal end portion 51*x*. This fan shaped space communicates with the circular cylindrical space and is widened so as to be connected to the opening 51*a*. The opening 51*a* is elongated in the sub-scanning direction, and its length is generally equal to that of the ejection face 1*a* in the sub-scanning direction. It is noted that the basal end portion 51*x* is greater in size of outer shape than the distal end portion 51*y*.

As shown in FIG. 7, each joint 51 is fixed to a corresponding one of through holes 5*a* of the head holder 5. Specifically, the distal end portion 51*y* is fitted in the through hole 5*a*, and a space therebetween is filled with a sealant.

The tube 55 includes: a main portion 55*a* common to the two heads 1, 2; and two branch portions 55*b* branched from the main portion 55*a*. Likewise, the tube 57 includes: a main portion 57*a* common to the two heads 1, 2; and two branch portions 57*b* branched from the main portion 57*a*. FIGS. 6A and 6B show a connection state of a pair of the branch portions 55*b*, 57*b*, wherein the branch portion 55*b* is fitted in one of the joints 51, and the branch portion 57*b* is fitted in the other of the joints 51. The two heads 1, 2 share the main portions 55*a*, 57*a* and connected in parallel.

One end of the main portion 55*a* is connected to the branch portion 55*b*, and the other end thereof is connected to the tank 54. Likewise, one end of the main portion 57*a* is connected to the branch portion 57*b*, and the other end thereof is connected to the tank 54. That is, the tubes 55, 57 establish a communication between the ejection space S1 and the tank 54. Here, when the sealing mechanism is in the sealing state, the pump 56 can circulate the humid air.

The tank 54 stores water in its lower space and stores the humid air in its upper space. An upper wall of the tank 54 has an air communicating hole 53 through which the upper space and an ambient air communicate with each other. Here, the tube 57 communicates with the lower space of the tank 54 (beneath a water surface), and the tube 55 communicates with the upper space of the tank 54. It is noted that, when an amount of the water in the tank 54 becomes small, the tank 54 is replenished with water from a water replenish tank, not shown.

As shown in FIGS. 6A and 6B, the pump 56 is provided on the main portion 57*a*. When the pump 56 is being driven, an air is always transferred in one direction. This one direction is a direction directed from the pump 56 toward the tank 54. A check valve, not shown, is provided between the pump 56 and the tank 54 for inhibiting the water in the tank 54 from flowing into the pump 56.

The switching valve 59 is provided on and across the main portions 55*a*, 57*a*. In this explanation, it is assumed that each of the main portions 55*a*, 57*a* is divided into a corresponding one of tank-side main portions 55*a*', 57*a*' and a corresponding one of head-side main portions 55*a*", 57*a*" with the switching valve 59 as a boundary therebetween. In this case, a direction of an air flow in each of the head-side main portions 55*a*", 57*a*" is changed by the switching valve 59. The switching valve 59 is selectively changed or switched by the controller 100 (specifically, a maintenance control section 150 which will be described below) between a first switched state shown in FIG. 6A in which the humid air is supplied to the opening 51*a* and a second switched state shown in FIG. 6B in which the humid air is supplied to the opening 51*b*.

In this configuration, when the pump 56 is driven by the controller 100 with the switching valve 59 being in the first switched state, as shown in FIG. 6A, the air in the tank 54 is circulated along white arrows. The humid air in the upper space of the tank 54 is supplied into the ejection space S1 through the opening 51*a*. Since the sealing mechanism is in the sealing state in which the ejection space S1 is sealed off, the air in the ejection space S1 flows toward the opening 51*b* while being replaced with the humid air. Since the tube 57 communicates with the tank 54 underwater, the air having flowed from the ejection space S1 is humidified in the tank 54. The produced humid air is supplied into the ejection space S1 during the driving of the pump 56. On the other hand, when the pump 56 is driven by the controller 100 with the switching valve 59 being in the second switched state, as shown in FIG. 6B, the air in the tank 54 is circulated along black arrows. In this case, the humid air is supplied into the ejection space S1 through the opening 51*b*. The air in the ejection space S1 flows toward the opening 51*a* while being replaced with the humid air.

There will be next explained the controller 100 with reference to FIG. 8. The controller 100 includes: a central processing unit (CPU); a read only memory (ROM) rewritably storing programs to be executed by the CPU and data used for these programs; and a random access memory (RAM) temporarily storing data in the execution of the programs. The controller 100 includes various functional sections which are constituted by cooperation of these hardware and software in the ROM with each other. As shown in FIG. 8, the controller 100 includes a conveyance control section 141, an image-data storage section 142, a head control section 143, the jam sensing section 144, the maintenance control section 150, a time measuring section 151, a judgment section 152, and an area judgment section 153.

The conveyance control section 141 controls the sheet-supply portion 23, the guide portions 10*a*, lob, and the conveyor mechanism 40 based on the recording command received from the external device such that the sheet P is conveyed at a predetermined speed in the conveying direction. The image-data storage section 142 stores therein the image data (the liquid ejection data) contained in the recording command transmitted from the external device. It is noted that, in the present embodiment, liquid ejection data for the pretreatment liquid is determined in advance based on the image data. Specifically, the liquid ejection data for the pretreatment liquid is determined in advance such that the pretreatment liquid is to be landed on positions (dot areas) onto which the ink is to be ejected from the head 1 based on the image data. That is, the pretreatment liquid is ejected onto areas on which the image is to be recorded, and is not ejected onto areas on which the image is not to be recorded.

In the image forming and the maintenance, the head control section 143 controls the heads 1, 2 to respectively eject the ink and the pretreatment liquid. In the image forming, the head control section 143 controls the heads 1, 2 to eject the ink and the treatment liquid onto the sheet P based on the image data (the liquid ejection data) stored in the image-data storage section 142. A timing of the liquid ejection is determined based on the sense of the leading end of the sheet P by the sheet sensor 26. In the present embodiment, the timing of the liquid ejection is a timing when a predetermined length of time is elapsed from the sense. It is noted that, in each of the heads 1, 2, this predetermined length of time is a time obtained by dividing, by a conveying speed of the sheet P, a distance along the conveyance path from the leading end of the sheet P at a timing when the sheet sensor 26 senses the leading end of the sheet P to the most upstream one of the ejection openings 108. The maintenance (the flushing operation) is performed based on the flushing data, and the pretreatment liquid and the ink are ejected onto the conveyor belt 43.

The jam sensing section 144 senses an occurrence of a jam (a paper jam) between the ejection face 1*a* and the conveyor belt 43 when the sheet sensor 27 has not sensed the leading end of the sheet P for a predetermined length of time after the sheet sensor 26 has sensed the leading end of the sheet P. This predetermined length of time is a time obtained by dividing a distance between the two sheet sensors 26, 27 by the conveying speed of the sheet P. When the jam is sensed, the jam sensing section 144 controls the head control section 143 and the conveyance control section 141 to stop the ejection of the pretreatment liquid and the ink and the conveyance of the sheet P. When the jam is sensed, the jam sensing section 144 also controls a buzzer 30 (see FIG. 8) to produce a sound. This notifies a user of the occurrence of the jam. It is noted that the jam sensing section 144 and the sheet sensors 26, 27 constitute the jam sensing section 144.

The time measuring section 151 measures a jam dealing time that is a length of time extending from the sense of the occurrence of the jam by the jam sensing section 144 to a timing when a button 29 (as one example of an output portion) is pressed by the user. This time measuring section 151 can be considered as one example of a measurement section configured to measure a duration (a length of continuous time) of a state of the jam whose occurrence has been sensed by the jam sensing section 144. The button 29 is a button pressed by the user after the jammed sheet P is removed (that is, after jam dealing is performed). When the button 29 is pressed, the supply and conveyance of the sheet P and the image recording are restarted. Further, when the button 29 is pressed, a jam-dealing (jam-clearance) completion signal indicating the removal (clearance) of the jam (i.e., a recovery from the jam) is outputted to the controller 100. It is noted that, when receiving the jam-dealing completion signal, the controller 100 controls the buzzer 30 to stop producing the sound. The conveyance control section 141 and the head control section 143 then restart the recording that is stopped by the jam.

The judgment section 152 judges and determines which of the jam dealing (clearance) time and a first predetermined length of time or a second predetermined length of time is longer. In the present embodiment, the first predetermined length of time is set at four hours, and the second predetermined length of time is set at fifteen hours.

Based on the image data stored in the image-data storage section 142, the area judgment section 153 judges which side of a center of the sheet P in the main scanning direction, a recording density of the pretreatment liquid (the ink) ejected on the sheet P is higher. In other words, the area judgment section 153 judges which of a one-end side and the other-end side of the sheet P is a high density area onto which a greater amount of the pretreatment liquid (the ink) is ejected. It is noted that, in the present embodiment, where the one-end side of the sheet P and the other-end side of the sheet P have the same recording density of the pretreatment liquid (the ink) as each other, the area judgment section 153 judges that the one-end side of the sheet P is the high density area. It is noted that the recording density is a value calculated based on the amount of the pretreatment liquid (the ink) ejected onto a unit area on the sheet P.

Where the jam dealing time is less than the first predetermined length of time, the maintenance control section 150 performs the purging and the wiping operation. In this operation, the maintenance control section 150 controls the up/down motor 64, the pumps 38, the head raising and lowering mechanism 33, and the wiper units 36. When the jam dealing time is equal to or greater than the first predetermined length of time and less than the second predetermined length of time, the maintenance control section 150 controls the up/down motor 64, the pumps 38, the head raising and lowering mechanism 33, the wiper units 36, and the pump 56 of the humid-air supply mechanism 50 such that the capping and the humidifying operation are performed, and then a release of the capping, the purging, and the wiping operation are performed.

When the jam dealing time is equal to or greater than the second predetermined length of time, the maintenance control section 150 controls the up/down motor 64 to perform a waiting operation after the end of the humidifying operation and before the start of the purging operation. In the waiting operation, the up/down motor 64 waits for a third predetermined length of time in the sealing (capping) state (in the present embodiment, the third predetermined length of time is fifteen hours that is the same as the second predetermined length of time). Further, after the end of the humidifying operation and before the start of the waiting operation, the maintenance control section 150 controls the up/down motor 64, the pumps 38, the head raising and lowering mechanism 33, and the wiper units 36 to perform the release of the capping, the purging, and the wiping operation. Furthermore, after the end of the purging operation and before the start of the waiting operation, the maintenance control section 150 controls the up/down motor 64 and the pump 56 to perform the capping and the humidifying operation.

When the jam dealing time is equal to or greater than the first predetermined length of time, and the humidifying operation is performed, the maintenance control section 150 controls the switching valve 59 such that the humid air is supplied from one of the two openings 51*a*, 51*b* which is nearer to the high density area determined by the area judgment section 153 among the two openings 51*a*, 51*b*.

Further, the maintenance control section 150 performs the cleaning operation for cleaning the conveyor belt 43 after the flushing and the purging operation. In this cleaning operation, the maintenance control section 150 controls the moving mechanism 37*c* to move the cleaning-liquid application member 37*a* and the blade 37*b* to the contact position and controls the conveyor mechanism 40 via the conveyance control section 141 to rotate the conveyor belt 43 in the clockwise direction. In this conveyance, a running speed of the belt is less than that in the recording. Thus, the cleaning liquid is uniformly applied to the outer circumferential face of the conveyor belt 43, and the pretreatment liquid and the ink on the outer circumferential face are reliably removed (scraped) by the blade 37*b* together with the cleaning liquid.

Figure 9:
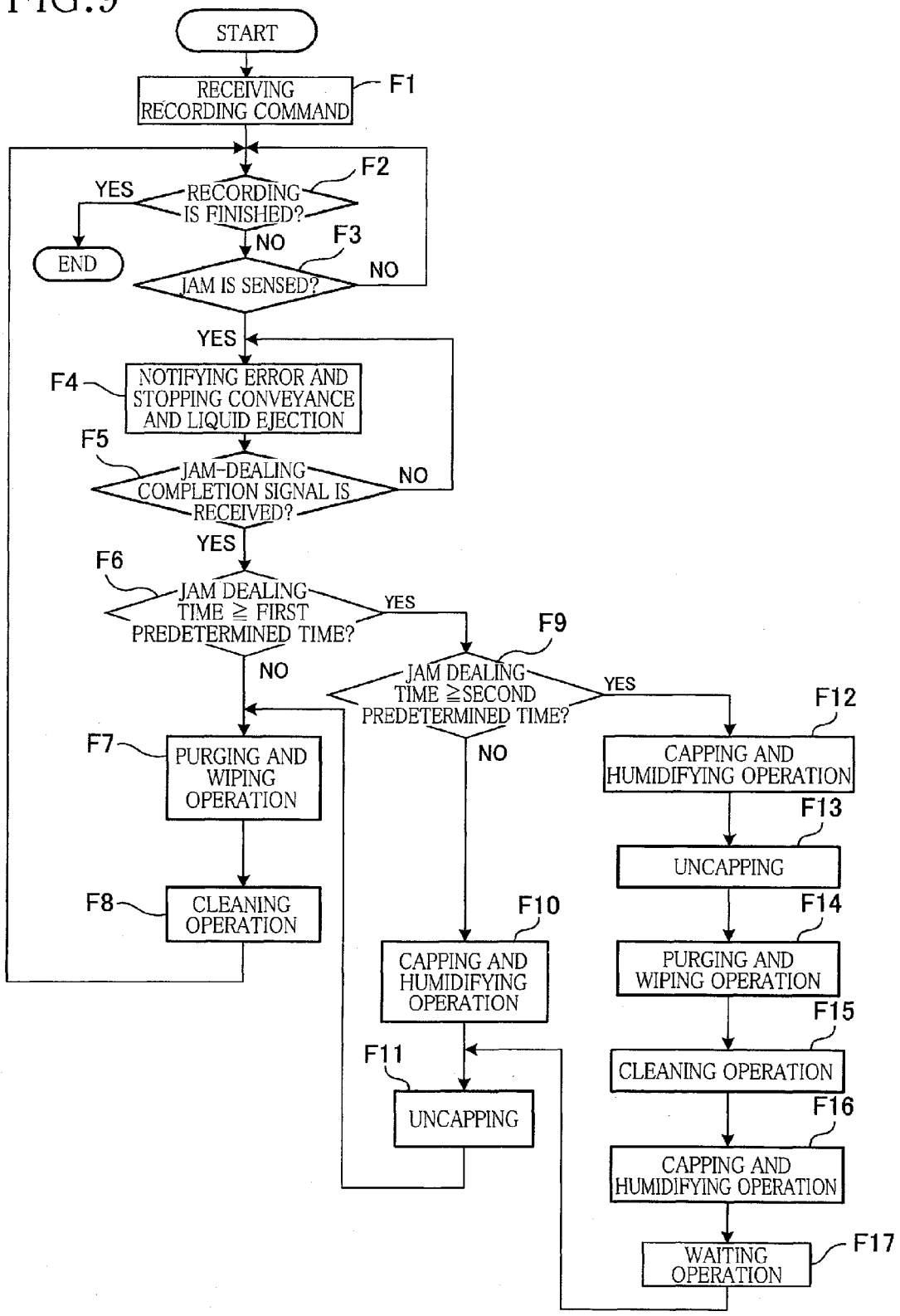
FIG. 9 is a flow-chart showing a series of operations relating to a maintenance operation controlled by the controller of the printer in FIG. 1.

There will be next explained the maintenance operation upon the occurrence of the jam of the sheet P in the recording operation with reference to a flow-chart in FIG. 9.

Initially, in step F1, the printer 101 receives the recording command from the external device. In this step, the image-data storage section 142 stores the image data contained in the recording command as the liquid ejection data for the heads 1, 2. The conveyance control section 141 then controls the sheet-supply portion 23, the guide portion 10*a*, 10*b*, and the conveyor mechanism 40 to start the conveyance of the sheet P from the sheet-supply portion 23 toward the sheet-discharge portion 4. Then in step F2, the head control section 143 controls the heads 1, 2 based on the image data stored in the image-data storage section 142 to start the image recording on the sheet P. Further, the head control section 143 judges whether all the image recordings are completed or not. When the head control section 143 judges that all the image recordings are completed (F2: YES), the recording operation is finished. Specifically, the conveyance control section 141 stops the components for conveying the sheet P such as the sheet-supply portion 23 and the conveyor mechanism 40 when the last sheet P has been discharged onto the sheet-discharge portion 4. When the image recording is being performed (F2: NO), this flow goes to step F3.

In step F3, the controller 100 judges whether the jam sensing section 144 is sensing the jam or not. When the controller 100 judges that the jam sensing section 144 is sensing the jam, this flow goes to step F4. Otherwise, this flow returns to step F2.

In step F4, the jam sensing section 144 controls the buzzer 30 to notify the user of the occurrence of the jam. Further, the jam sensing section 144 controls the head control section 143 and the conveyance control section 141 to stop the ejection of the liquid from the heads 1, 2 and the conveyance of the sheet P. In this step, the time measuring section 151 starts the measurement of the jam dealing time. This flow then goes to step F5.

The user having noticed the buzzing sound performs a jam dealing (clearance) operation for the printer 101, and thereby the jammed sheet P is removed. After the jam dealing, the user presses the button 29 to continue the recording processing having not been completed yet. At this time, the jam-dealing completion signal indicating the completion of the jam dealing is outputted. In step F5, the controller 100 waits for the reception of the jam-dealing completion signal. During this wait, the printer 101 continues its state in step F4. On the other hand, when the controller 100 has received the jam-dealing completion signal, the time measuring section 151 finishes measuring the jam dealing time, and this flow goes to step F6.

In step F6, the judgment section 152 judges whether the jam dealing time is equal to or greater than the first predetermined length of time. When the judgment section 152 judges that the jam dealing time is less than the first predetermined length of time (F6: NO), this flow goes to step F7. It is noted that the jam dealing time in the case where the judgment section 152 judges that the jam dealing time is less than the first predetermined length of time (F6: NO) is one example of a first duration.

In step F7, the purging and the wiping operation are performed. In the purging operation, the maintenance control section 150 controls each of the pump 38 to transfer the liquid of a predetermined amount to the corresponding one of the heads 1, 2. As shown in FIG. 10A, this forcible liquid transfer forces the liquid in each ejection opening 108 to be discharged onto the conveyor belt 43 together with the foreign matters. The maintenance control section 150 then moves the head holder 5 upward to perform the wiping operation. In this operation, the heads 1, 2 are moved from the recording position to the wiping position by the head raising and lowering mechanism 33. As shown in FIG. 10B, in the wiping operation, the maintenance control section 150 controls the wiper units 36 (the wiper moving mechanism 39) to respectively wipe the ejection faces 1*a*, 2*a* by the wipers 36*a*. An arrow in FIG. 10B indicates a wiping direction. When the wiping is completed, the maintenance control section 150 temporarily moves the two heads 1, 2 to the retracted position and then returns them to the recording position. When the heads 1, 2 are located at the retracted position, the maintenance control section 150 returns the wiper units 36 to the wait position. This flow then goes to step F8.

If the sheet P is brought into contact with the ejection face 1*a* due to the jam, the ink having contacted the pretreatment liquid on the sheet P (such as the ink remaining on the ejection face 1*a* and the ink in the ejection openings 108) coagulates or precipitates, resulting in production of foreign matters. Solidification and adhesion of the foreign matters to the ejection face 1*a* proceed with a lapse of time. In the present embodiment, if the elapsed time is less than four hours, the proceeding of the solidification and adhesion is not enough. Thus, it is possible to remove the foreign matters by the above-described purging and the wiping operation, that is, it is possible to clean the ejection face 1*a* and recover the ejection characteristic. If the elapsed time is equal to or greater than four hours, the foreign matters are partly solidified and adheres to the ejection face 1*a*. Thus, it difficult to remove the foreign matters only by the purging and the wiping operation. If the elapsed time is equal to or greater than fifteen hours, the foreign matters are completely solidified and adhere to the ejection face 1*a*. Thus, it is nearly impossible to remove the foreign matters by the purging and the wiping operation.

In step F8, the conveyor belt 43 is cleaned with the cleaning liquid, that is, the cleaning operation is performed. The maintenance control section 150 controls the moving mechanism 37*c* to move the cleaning-liquid application member 37*a* and the blade 37*b* to the contact position and controls the conveyor mechanism 40 via the conveyance control section 141 to rotate the conveyor belt 43. As a result, the cleaning liquid is applied to the outer circumferential face of the conveyor belt 43, and the discharged ink on the outer circumferential face is removed or scraped by the blade 37*b* together with the cleaning liquid. This flow then returns to step F2 in which the recording inhibited by the occurrence of the jam is restarted. That is, where the negative decision is made in step F6, the humidifying operation is not performed.

On the other hand, when the judgment section 152 judges in step F6 that the jam dealing time is equal to or greater than the first predetermined length of time (F6: YES), this flow goes to step F9. In step F9, the judgment section 152 judges whether the jam dealing time is equal to or greater than the second predetermined length of time. When the judgment section 152 judges that the jam dealing time is less than the second predetermined length of time, this flow goes to step F10. When the judgment section 152 judges that the jam dealing time is equal to or greater than the second predetermined length of time, this flow goes to step F12. It is noted that the jam dealing time in the case where the judgment section 152 judges that the jam dealing time is equal to or greater than the first predetermined length of time (F6: YES) is one example of a second duration.

In step F10, the humidifying operation is performed in the capping state. Specifically, the maintenance control section 150 controls the up/down motor 64 to change the ejection space S1 to the capping state (the sealing state). In this operation, the projecting portion 61*a* of the cap 60 is brought into contact with an upper face of the conveyor belt 43. The maintenance control section 150 then drives the pump 56 for a predetermined length of time to perform the humidifying operation. As a result, the ejection space 51 is filled with the humid air.

On the sheet P having contacted the ejection face 1*a* in the jam of the sheet P, a large amount of the foreign matters are produced on an area of the ejection face 1*a* which has a high recording density. Meanwhile, in the humidifying operation, the nearer to the opening through which the humid air is supplied, the larger amount of water (moisture) is supplied. This water supply softens the foreign matters, enabling the removal of the foreign matters by the purging and the wiping operation. Therefore, the humidifying operation may be performed such that the controller 100 extracts an area on the sheet P which has a relatively high recording density, and the humid air is supplied through one of the openings 51*a*, 51*b* which is nearer to the high density area. In the present embodiment, the area judgment section 153 judges which area is the high density area. The maintenance control section 150, based on a result of this judgment, controls the switching valve 59 to switch a tube to communicate with the tank-side main portion 55*a*' of the tube 55 to perform the humidifying operation.

In step F11, the maintenance control section 150 controls the up/down motor 64 to release the capping and changes the sealing mechanism to the unsealing state in which the ejection space S1 is not isolated. This flow then goes to step F7 and step F8 in which the above-described processings are executed. As a result, even if the solidification and adhesion of the foreign matters have proceeded in some degree, it is possible to suppress the lowering of a recording quality due to an ejection failure.

In steps F12-F15, the humidifying operation is performed in the capping state, then the purging and the wiping operation are performed after the release of the capping, and then the cleaning operation is performed as in steps F10, F11, F7, and F8. These operations remove a part of the foreign matters whose degree of the proceedings of the solidification and adhesion is relatively low, with another part of the foreign matters remaining. As a result, new (fresh) meniscuses are produced in a large number of the ejection openings 108 among them.

Then in step F16, the humidifying operation is performed again in the capping state as in step F10, and this flow goes to step F17. In step F17, the waiting operation is performed. Specifically, the maintenance control section 150 controls the up/down motor 64 to wait in the capping state for the third predetermined length of time. This flow then goes to step F11, and the above-described processings are performed.

As thus described, where the jam dealing time is equal to or greater than the second predetermined length of time, the waiting operation is performed. The waiting operation is performed for sufficiently supplying water to the foreign matters solidified and adhering to the ejection face 1*a*. By the wiping operation in step F14, water is supplied to surfaces of the foreign matters directly from the wiped ink. In addition, in the waiting operation, water is supplied to the foreign matters solidified and adhering to the ejection face 1*a* continuously from the ink meniscuses newly produced (recovered) in step F14 and the humid air supplied in step F16. After the third predetermined length of time has passed, the foreign matters solidified and adhering to the ejection face 1*a* are softened and can be removed by the purging and the wiping operation (step F7). After step F17, as shown in FIG. 9, this flow goes to step F11, F7, and F8 in order. As a result, the ejection characteristic of the entire head 1 can be recovered. It is noted that, even if a viscosity of the ink increases in the waiting operation, characteristics of the recovered ink meniscuses can be reliably recovered by the processing in step F7.

The above-described processings are performed after the jam dealing operation of the user is completed, and when the jam sensing section 144 is not sensing the jam in step F3, the recording is finished.

As described above, in the printer 101 as the present embodiment, if the pretreatment liquid contacts the ejection face 1*a* by the jam, the ejection opening(s) 108 may be clogged by the lump (the foreign matter) formed by the coagulation or the precipitation of the components of the ink. Where the jam dealing time in this case is equal to or greater than the first predetermined length of time, the purging operation is performed after the humidifying operation. Water is supplied to the lump near the ejection opening in the humidifying operation, and thereby the lump is softened. This makes it possible to discharge the soften lump by the purging operation, and thereby the ejection failure can be resolved.

Further, the head 2 ejects the pretreatment liquid onto the sheet P based on the image data. As a result, the treatment-liquid application portion can apply the treatment liquid to areas on the sheet P on which the image is to be formed. Thus, an amount of the pretreatment liquid adhering to the ejection face 1*a* in the jam is reduced when compared with a case where the pretreatment liquid is applied to an entire face of the sheet P at each time. Further, the ink is forcibly discharged from the ejection openings 108 by the driving of the pump 38, thereby simplifying the structure of the forcible discharge mechanism.

Further, since the printer 101 includes the wiper units 36, the foreign matters such as the liquid having contacted the ejection faces 1*a*, 2*a* in the purging operation can be wiped by the respective wipers 36*a*. Thus, no foreign matters remain on the ejection faces 1*a*, 2*a*, thereby stabilizing characteristics of the liquid ejection from the ejection openings 108.

While the embodiment of the present invention has been described above, it is to be understood that the invention is not limited to the details of the illustrated embodiment, but may be embodied with various changes and modifications, which may occur to those skilled in the art, without departing from the spirit and scope of the invention. For example, where the jam dealing time is equal to or greater than the first predetermined length of time in step F6, the flow may transfer from step F6 to step F10. That is, the processing in step F9 may be omitted. Further, the processings in steps F12-F17 may also be omitted. Alternatively, only the processing in step F16 may be omitted. In this case, the processing in step F14 may be omitted. This simplifies the control after the jam dealing operation.

Instead of the head 2, a sponge roller filled with the pretreatment liquid may be provided. In this case, the pretreatment liquid is applied to the entire face of the sheet P, but the construction of the printer 101 is simplified.

In the above-described embodiment, the purging operation is performed as a forcible discharge operation of the ink, but the maintenance control section 150 may control the actuators (the forcible discharge mechanism) via the head control section 143 to eject or discharge a plurality of the ink droplets from all the ejection openings 108. That is, the flushing operation may be performed instead of the purging operation. Further, the printer 101 may be configured such that a recessed cap member covers the ejection face 1*a* to establish the sealing state in which the ejection space S1 is isolated, and a pressure in the ejection space S1 may be a negative pressure that is lower than an ink meniscus withstanding pressure formed in each ejection opening 108. The ink in the ejection openings 108 may be sucked by the purging in this state.

As the sealing mechanism capable of selectively taking one of the sealing state and the unsealing state, there may be employed a mechanism including: a cap having a bottom portion opposite the ejection face 1*a* and an annular portion provided upright on a peripheral portion of the bottom portion; and a moving mechanism configured to selectively move the cap to one of a position at which a distal end of the annular portion contacts the ejection face 1*a* and a position at which the distal end is distant from the ejection face 1*a*. In this case, the bottom portion of the cap may have a supply opening and a discharge opening for the humid air. In this alternative configuration, the wiping operation is performed after the purging operation. Thus, the ink never contacts the cap when the ejection face 1*a* is covered with the cap next time.

In the above-described embodiment, the wipers 36*a* of the wiper moving mechanism 39 are moved in the main scanning direction, but the moving mechanism may move the heads 1, 2 or may move both of the wipers 36*a* and the heads 1, 2 relatively to each other. Further, in the above-described embodiment, the capping state is released (F11, F13) before a start of a forcible discharge operation after the humidifying operation (F10, F12) in the capping state (noted that this forcible discharge operation is a purging operation in F7 and F14 and may be hereinafter referred to as "after-humidification forcible discharge operation"), and this after-humidification forcible discharge operation is performed after the sealing mechanism is changed to the unsealing state. However, the sealing mechanism may not be changed to the unsealing state before the after-humidification forcible discharge operation. For example, the after-humidification forcible discharge operation may be performed without establishing the unsealing state, that is, the after-humidification forcible discharge operation may be performed in the state in which the sealing mechanism is in the sealing state.

The present invention is also applicable to a line printer and a serial printer. The present invention may be applied not only to the printer but also to devices such as a facsimile machine and a copying machine. Further, the present invention is applicable to a liquid ejection apparatus configured to eject liquid other than the ink to perform the recording. The recording medium is not limited to the sheet P, and various recordable media may be used. The present invention may be applied to a liquid ejection apparatus of any ink ejection method. For example, piezoelectric elements are used in the present embodiment, but various methods may be used such as a resistance heating method and an electrostatic capacity method.

What is claimed is:

1. A liquid ejection apparatus, comprising:

a conveyor mechanism configured to convey a recording medium in a conveying direction;

a recording head having a recording ejection face that has a plurality of ejection openings from which the recording head ejects recording liquid onto the recording medium, an ejection space being defined so as to face the recording ejection face;

a treatment-liquid application portion provided upstream of the recording head in the conveying direction and configured to apply treatment liquid to the recording medium, the treatment liquid containing a component for coagulating or precipitating a component in the recording liquid;

a sealing mechanism configured to selectively take one of (i) a sealing state in which the sealing mechanism seals the ejection space from an outside space and (ii) an unsealing state in which the sealing mechanism does not seal the ejection space from the outside space;

a humid-air supply mechanism configured to perform a humidifying operation in which the humid-air supply mechanism produces humid air to supply the humid air into the ejection space in the sealing state;

a forcible discharge mechanism configured to perform a forcible discharge operation in which the forcible discharge mechanism applies a pressure to the recording liquid in the recording head to forcibly discharge the recording liquid from the plurality of ejection openings;

a jam sensing section configured to sense an occurrence of a jam of the recording medium between the conveyor mechanism and the recording ejection face;

an output portion configured to output a jam-dealing completion signal corresponding to a clearance of the jam which allows the conveyor mechanism to convey the recording medium;

a measurement section configured to measure a time elapsed from the sense of the occurrence of the jam by the jam sensing section to the output of the jam-dealing completion signal by the output portion; and a maintenance control section configured, when the time measured by the measurement section is less than a first time, to control the forcible discharge mechanism to perform the forcible discharge operation, and configured, when the time is equal to or greater than the first time, to control the sealing mechanism and the humid-air supply mechanism to perform the humidifying operation in the state in which the sealing mechanism is in the sealing state and then control the forcible discharge mechanism to perform the forcible discharge operation.

2. The liquid ejection apparatus according to claim 1, wherein, when the time measured by the measurement section is less than the first time, the maintenance control section controls the sealing mechanism and the humid-air supply mechanism not to perform the humidifying operation in the state in which the sealing mechanism is in the sealing state.

3. The liquid ejection apparatus according to claim 1, wherein, when the time measured by the measurement section is equal to greater than the first time, the maintenance control section controls the sealing mechanism, the humid-air supply mechanism, and the forcible discharge mechanism to perform the humidifying operation in the state in which the sealing mechanism is in the sealing state and then to perform the forcible discharge operation in the state in which the sealing mechanism is in the unsealing state.

4. The liquid ejection apparatus according to claim 1, wherein, when the time measured by the measurement section is equal to or greater than a second time that is greater than the first time, the maintenance control section performs a waiting operation for waiting a third time in the sealing state after the humidifying operation and before the forcible discharge operation.

5. The liquid ejection apparatus according to claim 1, wherein, when the time measured by the measurement section is equal to or greater than a second time that is greater than the first time, the maintenance control section, after the humidifying operation and before a waiting operation for waiting a third time in the sealing state, controls the sealing mechanism to change the sealing mechanism to the unsealing state and then controls the forcible discharge mechanism to perform the forcible discharge operation.

6. The liquid ejection apparatus according to claim 5, wherein, after the forcible discharge operation and before the waiting operation, the maintenance control section controls the sealing mechanism to change the sealing mechanism to the sealing state and then controls the humid-air supply mechanism to perform the humidifying operation.

7. The liquid ejection apparatus according to claim 1, wherein the treatment-liquid application portion is a treatment-liquid head having a treatment-liquid ejection face that has a plurality of ejection openings from which the treatment-liquid head ejects the treatment liquid onto the recording medium, and wherein the treatment-liquid head is configured to eject the treatment liquid onto the recording medium based on image data relating to an image to be recorded on the recording medium.

8. The liquid ejection apparatus according to claim 7, further comprising an area judgment section configured to judge a high density area whose recording density is greater than that of the other areas in a perpendicular direction perpendicular to the conveying direction, based on part of the image data relating to a recording medium that has caused the jam, wherein the humid-air supply mechanism includes:

two openings each formed for supplying or discharging the humid air therethrough to or from the ejection space and formed so as to interpose the plurality of ejection openings of the recording head in the perpendicular direction; and a supply-opening switch portion configured to selectively switch an opening through which the produced humid air is to be supplied, to one of the two openings, and wherein the maintenance control section is configured to control the supply-opening switch portion in the humidifying operation to switch the opening through which the produced humid air is to be supplied, to one of the two openings which is nearer to the high density area judged by the area judgment section among the two openings.

9. The liquid ejection apparatus according to claim 1, wherein the forcible discharge mechanism includes a pump configured to transfer the recording liquid to the recording head to perform the forcible discharge operation, and wherein the maintenance control section is configured to control the pump to perform the forcible discharge operation.

10. The liquid ejection apparatus according to claim 1, further comprising:

a wiper configured to wipe the recording ejection face; and a moving mechanism configured to move at least one of the wiper and the recording head such that the wiper is moved relative to the recording ejection face while contacting the recording ejection face, wherein the maintenance control section is configured to control the moving mechanism to perform a wiping operation in which the wiper wipes the recording ejection face, just after an end of the forcible discharge operation.

11. A liquid ejection apparatus, comprising:

a conveyor mechanism configured to convey a recording medium in a conveying direction;

a recording head having a recording ejection face that has a plurality of ejection openings from which the recording head ejects recording liquid onto the recording medium, an ejection space being defined so as to face the recording ejection face;

a treatment-liquid application portion provided upstream of the recording head in the conveying direction and configured to apply treatment liquid to the recording medium, the treatment liquid containing a component for coagulating or precipitating a component in the recording liquid;

a sealing mechanism configured to selectively take one of (i) a sealing state in which the sealing mechanism seals the ejection space from an outside space and (ii) an unsealing state in which the sealing mechanism does not seal the ejection space from the outside space;

a humid-air supply mechanism configured to perform a humidifying operation in which the humid-air supply mechanism produces humid air to supply the humid air into the ejection space in the sealing state;

a forcible discharge mechanism configured to perform a forcible discharge operation in which the forcible discharge mechanism applies a pressure to the recording liquid in the recording head to forcibly discharge the recording liquid from the plurality of ejection openings;

a jam sensing section configured to sense an occurrence of a jam of the recording medium between the conveyor mechanism and the recording ejection face;

a measurement section configured to measure a time corresponding to a duration of a state of the jam whose occurrence has been sensed by the jam sensing section; and a maintenance control section configured, when the time corresponding to the duration is a first duration, to control the forcible discharge mechanism to perform the forcible discharge operation without performing the humidifying operation in the state in which the sealing mechanism is in the sealing state, and configured, when the time corresponding to the duration is a second duration that is greater than the first duration, to control the sealing mechanism and the humid-air supply mechanism to perform the humidifying operation in the state in which the sealing mechanism is in the sealing state and then control the forcible discharge mechanism to perform the forcible discharge operation.

12. The liquid ejection apparatus according to claim 11, wherein, when the duration measured by the measurement section is less than a first time, the maintenance control section controls the forcible discharge mechanism to perform the forcible discharge operation, wherein, when the duration is equal to or greater than the first time, the maintenance control section controls the sealing mechanism and the humid-air supply mechanism to perform the humidifying operation in the state in which the sealing mechanism is in the sealing state and then controls the forcible discharge mechanism to perform the forcible discharge operation, and wherein the first duration is less than the first time, and the second duration is equal to or greater than the first time.

* * * * *